US006095781A

United States Patent [19]

Petersen et al.

[11] Patent Number: 6,095,781

[45] Date of Patent: Aug. 1, 2000

[54] TIMED ELEMENT, HIGH PRESSURE, INDUSTRIAL ROTARY LOBE PUMP

[75] Inventors: John Edwin Petersen; James Michael Mayer, both of Cedar Falls; Victor Christian Iehl, Waterloo; Michael Robert Crawford, Cedar Falls, all of Iowa

[73] Assignee: Viking Pump, Inc., Cedar Falls, Iowa

[21] Appl. No.: 08/927,800

[22] Filed: Sep. 11, 1997

[51] Int. Cl.[7] ..... F04C 2/18; F04C 15/00

[52] U.S. Cl. ..... 418/107; 418/206.4; 418/206.6; 418/206.7; 29/888.023

[58] Field of Search ..... 418/206.7, 107, 418/206.4, 206.1, 206.6; 29/888.023

[56] References Cited

U.S. PATENT DOCUMENTS

| | | | |
|---|---|---|---|
| 60,366 | 12/1866 | Hardy et al. . | |
| 1,348,772 | 8/1920 | Auger | 418/206.1 |
| 1,669,050 | 5/1928 | Grant . | |
| 2,096,490 | 10/1937 | Hansen . | |
| 2,115,325 | 4/1938 | Behringer | 418/206.7 |
| 2,193,273 | 3/1940 | Dietzel . | |
| 2,247,454 | 7/1941 | Thomson . | |
| 2,279,136 | 4/1942 | Funk . | |
| 2,580,006 | 12/1951 | Densham . | |
| 2,633,807 | 4/1953 | Collura . | |
| 2,635,552 | 4/1953 | Dale et al. . | |
| 2,642,808 | 6/1953 | Thomas . | |
| 2,672,823 | 3/1954 | Thomson et al. . | |

(List continued on next page.)

FOREIGN PATENT DOCUMENTS

| | | |
|---|---|---|
| 664418 | 6/1960 | Canada . |
| 0 225 937 A1 | 12/1985 | European Pat. Off. . |
| 0 577 064 A1 | 6/1993 | European Pat. Off. . |
| 1133668 | 10/1955 | France . |
| 1642072 A1 | 4/1991 | U.S.S.R. . |

OTHER PUBLICATIONS

Brochure entitled "Tuthill HD Process Pumps—Standard Duty", distributed by Tuthill Corporation.

Brochure entitled "Tuthill HD Process Pumps", distributed by Tuthill Corporation, Tuthill Pump Division (Catalog 150–D).

Brochure entitled "Waukesha Universal Pumps", distributed by Waukesha Pumps (1991).

Brochure entitled "Viking Classic Pump", distributed by Viking Pump, Inc. (1993).

Brochure entitled "Viking Classic: Your Solution for Solids or Shear–Sensitive Products", distributed by Viking Pump, Inc.

Brochure entitled "Viking DuraLobe Pump", distributed by Viking Pump, Inc. (1994).

Brochure entitled "The Moyno SP Advantage", distributed by Robbins Myers (1988).

Brochure entitled "Leistritz L4 Series", distributed by Leistritz.

Brochure entitled "The SR Pump Range", distributed by SSP Pumps Ltd.

*Primary Examiner*—John J. Vrablik
*Attorney, Agent, or Firm*—Hill & Simpson

[57] ABSTRACT

A dual shaft, timed element high pressure industrial rotary lobe pump is provided. Lubricated sleeve bearings are located adjacent to the pumping elements. If the sleeve bearings are disposed on both opposing sides of the pumping elements, the lobe pump of the present invention can be operated at pressures as high as 400 psi. If sleeve bearings are disposed on one side of the pumping elements, the lobe pump can be operated at pressures up to 200 psi. Threaded thrust bearing cartridges enable fast and efficient positioning of the pumping elements during assembly without the use of shims. Recessed areas disposed in the head plate and in the casing bore provide improved loading and unloading of the pumping elements for high speed operation with reduced pressure pulsations and reduced noise. Access to the mechanical seals is simplified due to the easy removal of the timing gear box. The pump is also designed to accept standard mechanical seals as opposed to custom designed mechanical seals.

20 Claims, 4 Drawing Sheets

U.S. PATENT DOCUMENTS

| | | | |
|---|---|---|---|
| 3,050,011 | 8/1962 | Karl et al. . | |
| 3,089,638 | 5/1963 | Rose . | |
| 3,126,834 | 3/1964 | Bursak . | |
| 3,150,593 | 9/1964 | Funk et al. . | |
| 3,191,545 | 6/1965 | Funk . | |
| 3,371,856 | 3/1968 | Thelen et al. . | |
| 3,799,713 | 3/1974 | Cloots et al. | 418/206.4 |
| 3,817,667 | 6/1974 | Winkelstrater et al. | 418/150 |
| 3,844,695 | 10/1974 | Weatherston | 418/180 |
| 4,017,223 | 4/1977 | Blackwell | 418/107 |
| 4,293,290 | 10/1981 | Swanson | 418/94 |
| 4,462,770 | 7/1984 | Haupt | 418/206.7 |
| 4,621,994 | 11/1986 | Ellis | 418/70 |
| 4,639,199 | 1/1987 | Frings et al. | 418/3 |
| 4,846,641 | 7/1989 | Pieters et al. | 418/70 |
| 4,917,583 | 4/1990 | Frings et al. | 418/206.7 |
| 5,013,227 | 5/1991 | Guittet et al. . | |
| 5,069,606 | 12/1991 | Bachellerie | 418/58 |
| 5,152,684 | 10/1992 | Steffens | 418/150 |
| 5,370,514 | 12/1994 | Morita et al. | 418/205 |
| 5,468,132 | 11/1995 | Snell et al. . | |
| 5,567,140 | 10/1996 | Dodd | 418/206.1 |
| 5,571,004 | 11/1996 | Masters et al. | 418/107 |

TIMED ELEMENT, HIGH PRESSURE, INDUSTRIAL ROTARY LOBE PUMP

BACKGROUND OF THE INVENTION

The present invention is related generally to lobe-type pumps and more specifically to timed element, dual shaft lobe pumps for use in high pressure and industrial applications.

Lobe-type pumps are known in the art and traditionally have utility in sanitary applications including food products. The rotation of the lobes or impellers is timed so that the lobes do not come into contact with one another.

Many lobe pumps have been limited to low pressure applications, or pressures of less than 200 psi because each shaft is supported on one side of the lobe only. Specifically, because the pumping chamber is sealed for sanitary reasons, the shafts are supported with bearings disposed outside of the sealed pump chamber. The distal ends of the shafts are therefore not supported and because of the seals disposed between the bearings and the lobes, there is a substantial distance between the supporting bushings and the lobes. As a result, operation of the pumps are limited to pressures of less than 200 psi. Otherwise, the strain on the shafts can result in engagement between the lobes or between the lobes and the casing or head plate. Thus, the distance between the bearings and the lobes unduly limits the pressures at which these pumps can operate.

Accordingly, there is a need for an improved lobe pump design with an improved bearing placement which will enable lobe pumps to operate under high pressure conditions and which will expand the applicability of lobe pumps to different industrial applications.

A second problem associated with currently available lobe pumps is the positioning of the pumping elements or lobes during assembly of the pumps. Specifically, current designs require the employment of several shims which are typically 0.005" to 0.010" thick in order to accurately place the lobes in the desired position in the pumping chamber. The plastic shims are not very durable and, in the event the shims need to be replaced, the pump often needs to be sent back to the factory for service. Thus, not only is the assembly of lobe pumps more costly due to the employment of shims, the operation and use of lobe pumps is more expensive because the shims can be easily damaged or lost during routine servicing of the lobe pump. Accordingly, it would be beneficial to provide an improved lobe pump whereby the lobes or pumping elements can be accurately positioned within the casing or pumping chamber without the employment of shims.

Another disadvantage of currently available lobe pumps is the relatively low speed in which these pumps can be operated. The lower speeds are required due to the design of the pump casing or pump chamber which traditionally is required to be sanitary due to the use of lobe pumps in the food industry. Thus, it would be beneficial to provide an improved lobe pump casing and head plate design which would enable a lobe pump to be operated at higher speeds than conventional lobe pumps.

Still another problem associated with the employment of currently available lobe pumps is the use of customized seals in these pumps to isolate the pumping chamber from the timing gears and thrust bearings. The seals are often custom made and not readily available. Further, in addition to employing more expensive seals, it is difficult to replace seals in a lobe pump because the wet end of the pump must be disassembled in order to replace the seals. Accordingly, it would be desirable to provide a new lobe pump design which would provide fast and easy access to the seal for easy replacement thereof. Further, it would be desirable to provide a new lobe pump design which would utilize standard, "off-the-shelf" seals as opposed to custom made seals. Such a pump would be cheaper to manufacture and to maintain.

As a result of the above deficiencies, lobe pumps are relatively limited in their use. An improved lobe pump design would expand the applicability of lobe pumps beyond the food, beverage and dairy industries and beyond other low pressure applications.

SUMMARY OF THE INVENTION

The present invention satisfies the aforenoted needs by providing an improved dual shaft, timed element lobe pump that can be used at high speeds and high pressures. The higher speeds and higher pressures are achieved by the lobe pumps at least in part due to an improved head plate design which includes deep recessed areas on both sides of the lobes or pump elements which reduce pressure pulsations and noise and which further permit higher speed operation. The recessed areas may also extend into the casing bore.

The lobe pumps of the present invention can also operate at higher pressures due to the location of sleeve bearings disposed immediately adjacent to the lobes or pump elements. In an embodiment, sleeve bearings are disposed on both opposing sides of the lobes, one set of bearings being accommodated in the head plate and the other set of bearings being accommodated in apertures in the casing through which the driver and driven shafts pass. In such an embodiment, operating pressures of about 400 psi are contemplated. Two bearing embodiments, where the bearings are disposed in either the head plate or in the casing are contemplated for operating pressures of about 200 psi.

The lobe pumps of the present invention are also easier to manufacture because the lobes may be quickly and easily positioned within the casing through an incorporation of threaded thrust bearing assemblies disposed in a bearing housing. Rotation of the thrust bearing assemblies within the bearing housing results in axial movement of the shafts and therefore the lobes within the casing for fast and proper positioning of the lobes within the casing during manufacture. The threaded thrust bearing assemblies eliminate the need for shims.

An additional movement is provided by the incorporation of off-the-shelf mechanical seals as opposed to custom designed mechanical seals used in current lobe pumps.

Further, in an embodiment, the lobe pump of the present invention is designed so that the timing gear box can be removed easily which results in easy access to and replacement of the mechanical seals.

In an embodiment, a lobe pump made in accordance with the present invention includes a driver shaft and a driven shaft, each shaft passes through and is connected to a respective timing gear and a lobe gear. The lobe gears are disposed inside a casing. Each shaft also passes through and is connected to a thrust bearing assembly. Each thrust bearing assembly is disposed between the lobe gear and the timing gear of the respective shaft. Each thrust bearing assembly includes a bearing cartridge that accommodates at least one bearing between the cartridge and the shaft. The bearing cartridge is further threadably connected to a bearing housing that is in turn connected to the casing. As a result, rotation of the bearing cartridge with respect to the bearing housing results in axial movement of the shaft and lobe gear with respect to the casing thereby providing fast and efficient positioning of the lobe gears within the casing.

In an embodiment, the casing terminates at an open distal end which is covered by a head plate. The head plate includes two receiving apertures for receiving distal ends of the driver and driven shafts and for supporting the distal ends of the driver and driven shafts. In a preferred embodiment, the head plate comprises a pair of opposing recesses disposed on opposing sides of the distal ends of the driver and driven shafts. The recesses improve the loading and unloading of the lobe gears during operation of the pump. In an embodiment, the recesses extend into the casing bore.

In an embodiment, the casing of the pump of the present invention includes an aperture through which the driver shaft passes and an aperture through which the driven shaft passes. The apertures in the casing being disposed between the lobe gears and the thrust bearing assemblies. Each aperture accommodates sleeve bearings that are in communication with the pumping chamber and are lubricated by fluid that is pumped through the pumping chamber by the lobe gears.

In an embodiment, the apertures in the head plate which receive the distal ends of the driver and driven shafts are also equipped with sleeve bearings that are in fluid communication with the pumping chamber. As a result, the sleeve bearings which support the distal ends of the driver and driven shafts are lubricated by the fluid that is pumped by the lobe gears.

In an embodiment, a lobe pump of the present invention includes a pair of seal assemblies disposed around the driver and driven shafts and between the casing and bearing housing. A gear case cover is further provided that encloses the proximal end of the driven shaft and through which the proximal end of the driver shaft passes. Access to the seal assemblies is fast and efficient because the first and second timing gears can be removed from the driver and driven shafts after removal of the gear case cover. After removal of the timing gears, the first and second thrust bearing assemblies may be removed from the bearing case and driver and driven shafts by simply unscrewing them from the bearing housing. And after removal of the thrust bearing assemblies, the bearing housing can be removed from the casing thereby exposing the seal assemblies for easy removal and replacement thereof.

It is therefore an advantage of the present invention to provide an improved lobe pump design which includes sleeve bearings located adjacent to the lobe gears and which are lubricated by the liquid product being pumped through the pumping chamber.

Yet another advantage of the present invention is that it provides a lobe pump design with sleeve bearings disposed on opposing sides of the lobe gears and immediately adjacent thereto and which are lubricated by the liquid product being pumped through the pumping chamber.

Yet another advantage of the present invention is that it provides an improved lobe pump design which includes sleeve bearings disposed on opposing sides of the lobe gears and which are lubricated by the liquid product being pumped and which further may be used for pressures up to 400 psi.

Yet another advantage of the present invention is that it provides an improved lobe pump design which includes at least one sleeve bearing disposed immediately adjacent to each lobe gear and which is lubricated by the liquid product being pumped and which further enables the lobe pump to be used for pressures up to 200 psi.

Yet another advantage of the present invention is that it provides a lobe pump having two bushings or two bearings, one for the drive shaft and one for the driven shaft, which are disposed immediately adjacent to the lobes. Such a lobe pump design is intended for operating pressures up to about 200 psi.

Still another advantage of the present invention is that it provides an improved sleeve bearing position which provides positive support for the drive shaft and driven shaft which sufficiently eliminates deflection of the shafts at the shaft seals.

Another advantage of the present invention is that it provides thrust bearing assemblies that are threadably connected to a bearing housing which in turn is connected to the casing so that rotation of the thrust bearing assemblies within the bearing housing results in an axial positional adjustment of the shafts and the lobe gears within the casing without the use of shims.

Still another advantage of the present invention is that it provides a lobe pump with an improved head plate design having deep recesses adjacent to the lobe gears which improve the loading and unloading of the lobe gears. As a result, the lobe pump of the present invention can be operated at higher speeds than conventionally designed lobe pumps.

Another advantage of the present invention is that standard, off-the-shelf mechanical seals may be used to seal the driver and driven shafts against the casing.

Still another advantage of the present invention is that it provides an improved lobe pump design which provides an easy removal of the timing gear box which results in an easy access to and replacement of the mechanical seals.

Other objects and advantages of the present invention will become apparent upon reading the following detailed description and appended claims, and upon reference to the accompanying drawings.

BRIEF DESCRIPTION OF THE DRAWING

For a more complete understanding of the present invention, reference should now be made to the embodiment illustrated in greater detail in the accompanying drawing and described below by way of an example of the present invention.

In the drawing.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not limited to the particular embodiments illustrated herein.

DETAILED DESCRIPTION OF THE PRESENTLY PREFERRED EMBODIMENTS

Figure 1:
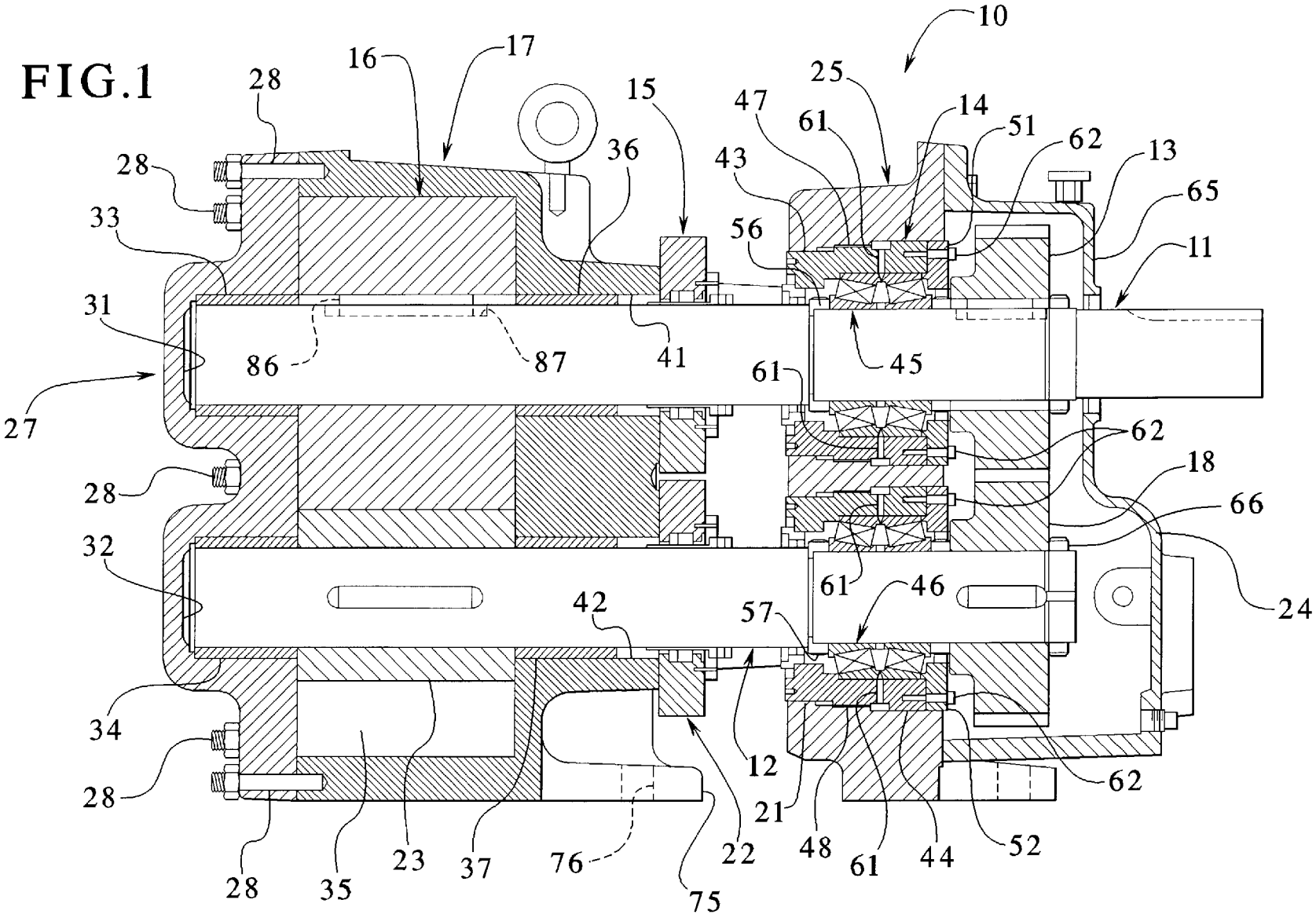
FIG. 1 is a side sectional view of a lobe pump made in accordance with the present invention.
Figure 2:
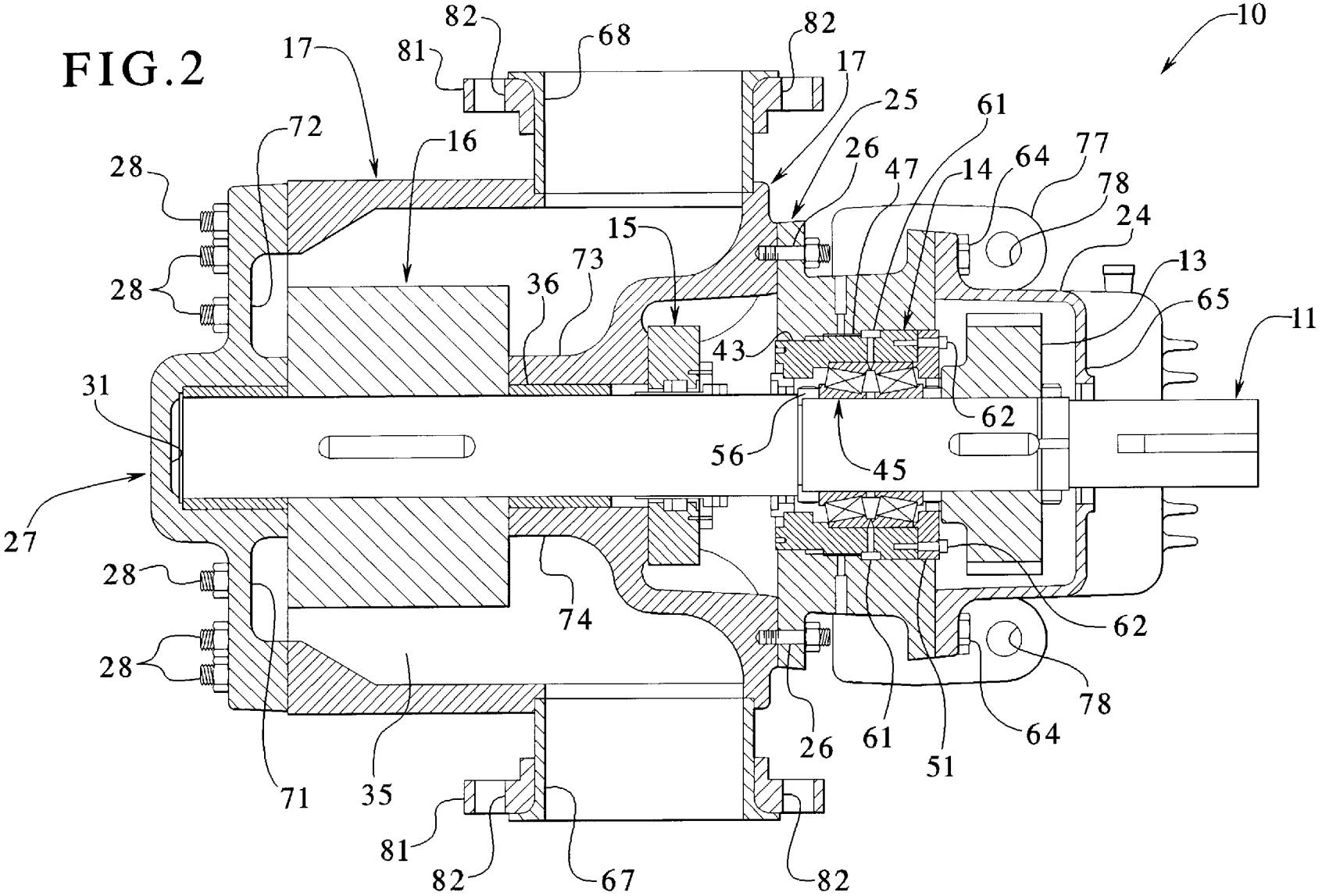
FIG. 2 is a top sectional view of the lobe pump shown in FIG. 1.

Turning first to FIG. 1, a pump 10 made in accordance with the present invention is illustrated in a side sectional view. The pump 10 includes a driver shaft 11 and a driven shaft 12. The driver shaft 11 passes through and is connected to a first timing gear 13 before passing through and being connected to a first thrust bearing assembly 14. Moving to the left in FIG. 1, the driver shaft 11 further passes through a first seal assembly 15 before passing through and being connected to a first lobe gear 16. The lobe gear 16 is disposed within the casing 17. Similarly, the driven shaft 12 passes through a second timing gear 18 which is in mesh with the first timing gear 13. The driven shaft 12 also passes through a second thrust bearing assembly 21, a second seal assembly 22 before passing through and being connected to a second lobe gear 23. A gear case cover 24 encloses the timing gears 13, 18 and is attached to a bearing housing 25 which encloses the thrust bearing assemblies 14, 21. As shown in FIG. 2, the thrust bearing housing 25 is attached to the casing 17 with a plurality of bolts, two of which are shown at 26 in FIG. 2.

Returning to FIG. 1, a head plate 27 is mounted onto an open distal end of the casing 17 with a plurality of bolts, five of which are indicated at 28. The head plate 27 includes receiving apertures 31, 32 for receiving distal ends of the driver shaft 11 and driven shaft 12 respectively. The distal ends of the shafts 11,12 are supported by sleeve bearings 33, 34 respectively. The sleeve bearings 33, 34 are disposed immediately adjacent to the lobe gears 16, 23 and are in fluid communication with the pump chamber 35. As a result, the sleeve bearings 33, 34 are lubricated by fluid being pumped through the pump chamber 35. Similarly, the driver shaft 11 and driven shaft 12 are also supported on an opposing side of the lobe gears 16, 23 by the sleeve bearings 36, 37 respectively. The sleeve bearings 36, 37 are respectively disposed in apertures 41, 42 in the casing 17. Again, the sleeve bearings 36, 37 are in fluid communication with the pump chamber 35 and are lubricated by fluid being pumped through the chamber 35 during operation of the pump 10.

Still referring to FIG. 1, the seal assemblies 15, 22 are of a standard mechanical type that are readily available. The off-the-shelf seal assemblies 15, 22 need not be custom designed because they are disposed between the casing 17 and the bearing housing 25 and the radial dimension of the seal assemblies 15, 22 is not limited by the design of the casing 17. As a result, because the diameter of the shafts 11,12 is standard, standard seal assemblies 15, 22 may be employed as well.

Still referring to FIG. 1, the thrust bearing assemblies 14, 21 include thrust bearing cartridges 43, 44 respectively. The cartridges accommodate and trap the bearings shown at 45, 46 between the cartridges 43, 44 and the shafts 11, 12 respectively. The cartridges 43, 44 are threadably connected to the bearing housing 25 at the thread pairs shown generally at 47, 48. Each thrust bearing assembly 14, 21 further includes an end cap shown respectively at 51, 52.

Figure 4:
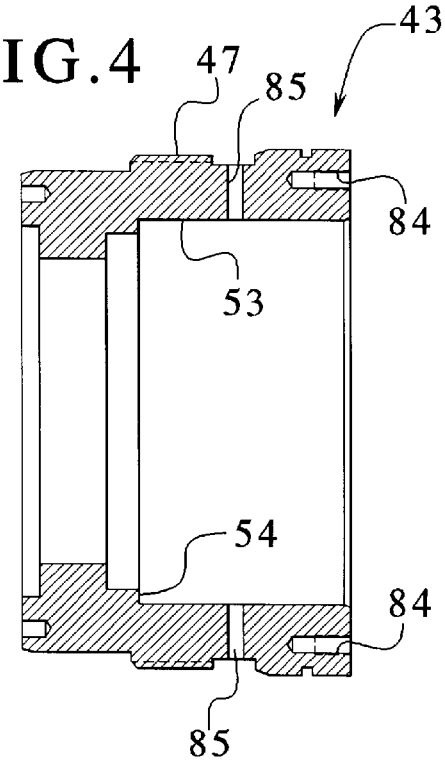
FIG. 4 is a side sectional view of a thrust bearing cartridge of the lobe pump first shown in FIG. 1.
Figure 6:
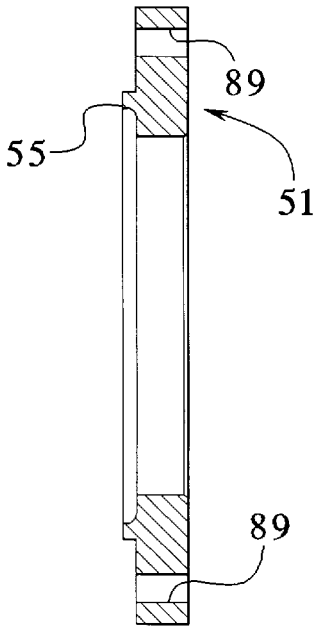
FIG. 6 is a side sectional view of a thrust bearing end cap of the lobe pump first shown in FIG. 1.

Referring collectively to FIGS. 1, 4 and 6, the bearing 45 is trapped in the recess 53 of the bearing cartridge 43 as shown in FIG. 4 and between the ledge 54 and the lip 55 of the end cap 51 as shown in FIG. 6. Further, referring back to FIG. 1, a retaining ring 56 is disposed around the driver shaft 11 which also engages the bearing 45. Thus, rotation of the bearing cartridge 43 within the bearing housing 25 results in axial movement of the cartridge 43, bearing 45 and therefore the driver shaft 11 either to the right or to the left as shown in FIG. 1. The ability to adjust the axial position of the driver shaft 11 enables the manufacturer to precisely adjust the axial position of the lobe gear 16 inside the pump chamber 35. The same relationship is provided between the bearing cartridge 44, end cap 52 and retaining ring 57 as shown in FIG. 1. The pins shown generally at 61 maintain the axial relationship between the bearing cartridges 43, 44 and the bearings 45, 46 respectively. The pins shown generally at 62 maintain the radial relationship between the end caps 51, 52 and the bearing cartridges 43, 44 respectively.

Referring collectively to FIGS. 1 and 2, access to the seal assemblies 15, 22 has been simplified with the design of the pump 10. Specifically, the gear case cover 24 is attached to the bearing housing 25 by a plurality of bolts, two of which are shown at 64. The gear case cover 24 can be easily removed from the bearing housing 25 by removing the bolts 64 without any disconnection of the timing gears 13 or 18. After the gear case cover 24 is removed, the timing gears 13, 18 may be removed by first removing the lock nuts 65, 66. After removal of the timing gears 13, 18, the thrust bearing assembly end caps 51, 52 are removed before the thrust bearing cartridges 43, 44 are unscrewed from the bearing housing 25. The bearings 45, 46 may then be easily changed. After removal of the thrust bearing assemblies 14, 21, the bearing housing 25 may be easily removed by unscrewing the bolts 26 as shown in FIG. 2. Removal of the bearing housing 25 exposes the mechanical seals 15, 22. The seals 15, 22 may then be easily removed and replaced without disruption to the wet end of the pump 10.

Assuming the driver shaft 11 rotates in a clockwise direction from a right side of FIG. 2, the inlet of the pump 10 is shown at 67 with the outlet being shown at 68. It will be noted that the head plate 27 includes recesses 71, 72 disposed adjacent to the lobe gear 16 as shown in FIG. 2. The recesses extend downward and are also disposed adjacent to the lobe gear 23 that is attached to the driven shaft 12. The geometry of the recesses and the position of the recesses with respect to the apertures 31, 32 which accommodate the distal ends of the shafts 11, 12 is further illustrated in FIG. 3. The recesses 71, 72 in the head plate in combination with the recesses shown at 73, 74 in the casing 17 facilitate the loading and unloading of the lobe gears 16, 23. As a result, the recesses 71–74 reduce pressure pulsations within the pump chamber 35 and noise generated by the pump 10 while permitting higher speed operation of the pump 10.

As illustrated in FIG. 1, the casing 17 includes a base portion 75 which can be mounted to a surface by inserting bolts (not shown) through the plurality of holes provided, one of which is shown at 76. Similarly, referring to FIG. 2, the bearing housing 25 also includes a base portion 77 with a plurality of holes, two of which are shown at 78 for mounting the base 77 to a surface. Still referring to FIG. 2, the inlet 67 and outlet 68 are similarly provided with brackets shown at 81 that include a plurality of holes 82 for mounting the inlet 67 and outlet 68 to a connecting pipe or conduit (not shown).

Figure 3:
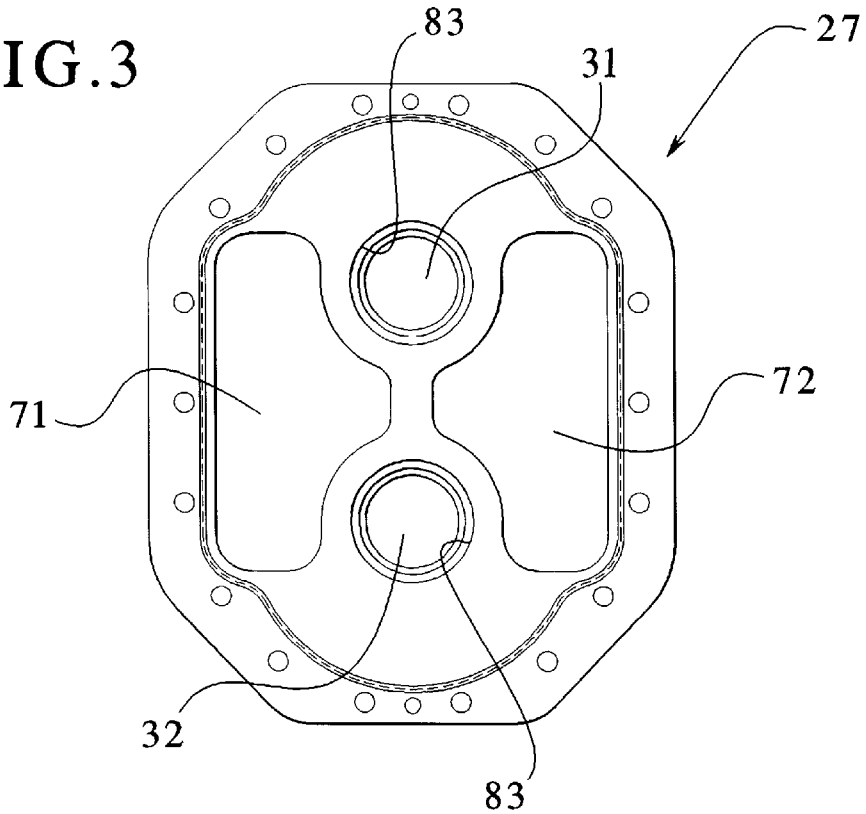
FIG. 3 is a plan view of the head plate of the lobe pump first shown in FIG. 1.

Turning to FIG. 3, an inside plan view of the head plate 27 is provided illustrating the general relationship between the receiving apertures 31, 32 in which the distal ends of the shafts 11, 12 are inserted and the recesses 71, 72 which facilitate the loading and unloading of the lobe gears 16, 23. Each recess 31, 32 includes an enlarged periphery 83 for accommodating one of the sleeve bearings 33, 34 respectively. The holes shown generally at 84 are provided for bolting the head plate 27 to the casing 17.

Figure 5:
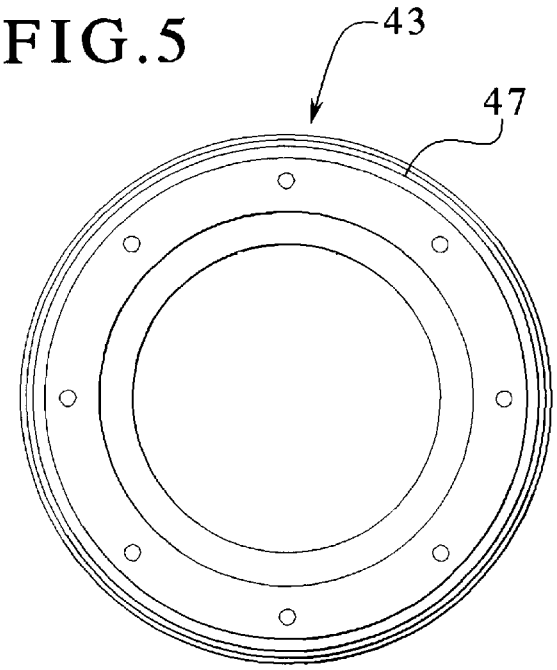
FIG. 5 is an end view of the thrust bearing cartridge shown in FIG. 4.

Turning to FIGS. 4 and 5, the bearing cartridge 43, which is identical to the bearing cartridge 44 (see FIG. 1) is illustrated in greater detail. The holes shown at 84 receive the pins 62 which attach the end cap 51 to the cartridge 43. The holes shown at 85 accommodate pins or set screws 61 which fix the bearing 45 to the interior of the cartridge 43 as shown in FIGS. 1 and 2. Threads are provided at 47 for connecting the cartridge 43 to the bearing housing 25. The outer periphery of the bearing 45 is accommodated in the recess shown at 53 and abuts the ledge shown at 54.

Figure 7:
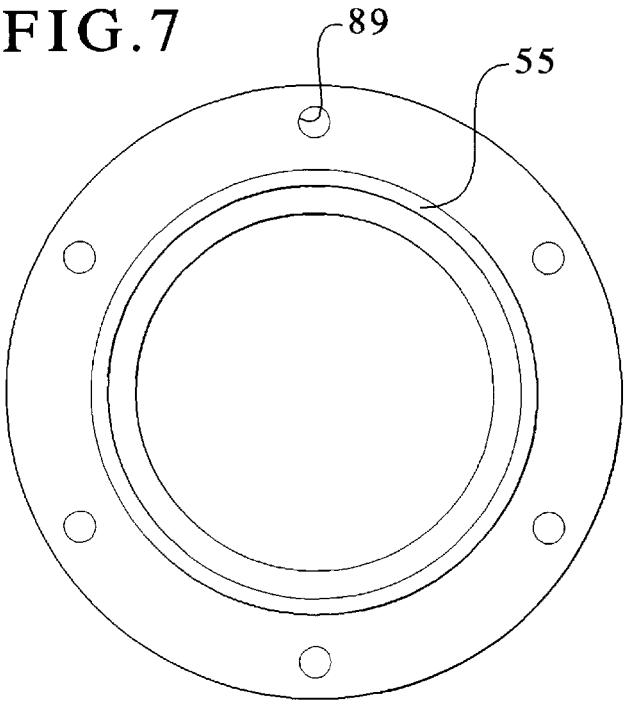
FIG. 7 is an end view of the thrust bearing end cap shown in FIG. 6.

Turning to FIGS. 6 and 7, the end cap 51, which is identical to the end cap 52 shown in FIG. 1 is illustrated in greater detail. The holes shown at 89 accommodate the pins 62 which attach the end cap 51 to the bearing cartridge 43 as shown in FIGS. 1 and 2. The inwardly protruding lip 55 engages the bearing assembly 45 and sandwiches the outer periphery of the bearing assembly 45 between the lip 55 and the ledge 54 of the bearing cartridge 43 (see FIGS. 1, 2 and 4).

Figure 8:
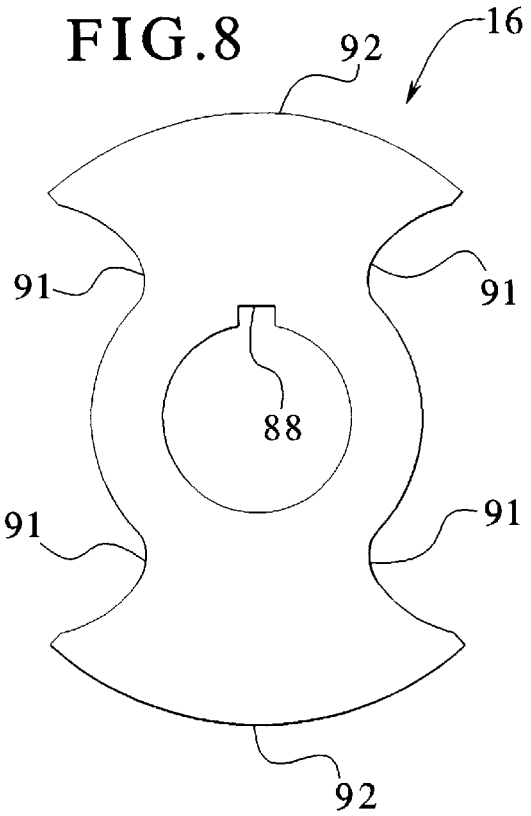
FIG. 8 is an elevational view of a lobe gear of the lobe pump first shown in FIG. 1.
Figure 9:
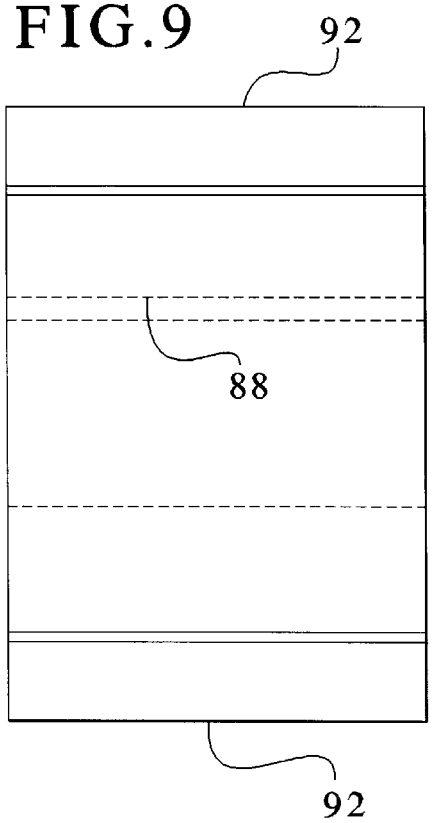
FIG. 9 is a side plan view of the lobe gear shown in FIG. 8.

Turning to FIG. 8, the lobe gear 16, which is identical to the lobe gear 23 shown in FIG. 1 is illustrated in greater detail. The lobe gear 16 is mounted onto the shaft 11 using a key and slot connection. Specifically, the key shown at 86 in FIG. 1 engages the slot 87 disposed in the driver shaft 11 as well as the slot 88 in the lobe gear 16 as shown in FIG. 8. Similar connection is provided to mount the lobe gear 23 onto the driven shaft 12. The profile of the lobe 16 is designed for high speed and high pressures. Specifically, the profile sections shown at 91 are concave with respect to the outer sections 92. The concave nature of the sections 91 enhances the pumping capacity of the lobe 16. Even though the profile of the lobe 16 is designed for high speed, high pressure operation, the design of the head plate 27 and casing 17, and more specifically, the recesses 7174 disposed therein, insure a smooth and quiet operation of the pump 10.

From the above description, it is apparent that the objects and advantages of the present invention have been achieved. The pump 10 is extremely easy to disassemble which facilitates the servicing of the mechanical seals 15, 22. The design of the head plate 27 and casing 17 enhances the loading and unloading of the lobes 16, 23 which permits a high speed operation with reduced pressure pulsations. Lubricated sleeve bearings are disposed on at least one, and preferably on both opposing sides of the lobes 16, 23 which enables the pump 10 to operate at pressures as high as 400 psi. The threaded thrust bearing assemblies 14, 21 enable the position of the lobes 16, 23 within the pump chamber 35 to be quickly and easily adjusted during assembly without the need for shims. The pump 10 can also accept off-the-shelf mechanical seals such as those shown at 15, 22 in FIGS. 1 and 2 as opposed to custom-designed mechanical seals which are typically used in the design of currently-available lobe pumps.

While only certain embodiments have been set forth, alternative embodiments and various modifications will be apparent from the above description to those skilled in the art. These and other alternatives are considered equivalents and within the spirit and scope of the present invention.

What is claimed is:

1. A high pressure rotary lobe pump comprising:

a driver shaft that passes through and is connected to a first timing gear, the driver shaft further passing through and being connected to a first lobe gear, the first lobe gear being disposed inside a casing, a driven shaft that passes through and is connected to a second timing gear, the driven shaft further passing through and being connected to a second lobe gear, the second lobe gear being disposed inside the casing, the casing further comprising an open distal end that is connected to a head plate and a proximal end that is connected to an inlet port and an outlet port, the inlet port being disposed diametrically opposite the casing from the outlet port, the driver shaft and driven shaft each comprising a distal end that engages the head plate, the head plate comprising two receiving apertures for receiving the distal ends of the driver and driven shafts, the head plate further being disposed adjacent to the first and second lobe gears, the lobe gears being disposed between the head plate and the inlet and outlet ports, the head plate comprising a pair of opposing recesses disposed on opposing sides of the distal ends of the driver and driven shafts, the recesses providing clearance between distal ends of the lobe gears and the head plate at the recesses, the recesses for improving loading and unloading of the first and second lobe gears.

2. The pump of claim 1 wherein the casing further comprising a pair of opposing recesses disposed on opposing sides of the lobe gears from the head plate, the recesses in the casing being in alignment with the recesses in the head plate, the recesses in the casing for improving loading and unloading of the first and second lobe gears.

3. The pump of claim 1 wherein the driver shaft also passes through and is connected to a first thrust bearing assembly, the first thrust bearing assembly being disposed between the first lobe gear and the first timing gear, the first thrust bearing assembly comprising a first bearing cartridge that accommodates at least one bearing between the driver shaft and the first bearing cartridge, the first thrust bearing cartridge further being threadably connected to a bearing housing that is connected to the casing whereby rotation of the first thrust bearing cartridge with respect to the bearing housing results in axial movement of the driver shaft and the first lobe gear within the casing, and the driven shaft also passing through and being connected to a second thrust bearing assembly, the second thrust bearing assembly being disposed between the second lobe gear and the second timing gear, the second thrust bearing assembly comprising a second bearing cartridge that accommodates at least one bearing between the driven shaft and the second bearing cartridge, the second thrust bearing cartridge further being threadably connected to the bearing housing whereby rotation of the second thrust bearing cartridge with respect to the bearing housing results in axial movement of the driven shaft and the second lobe gear within the casing.

4. The pump of claim 3 further comprising first and second seal assemblies disposed around the driver and driven shafts respectively and between the casing and the bearing housing, and wherein the driver and driven shafts each comprise proximal ends and wherein the bearing housing is connected to a gear case cover that encloses the first and second timing gears and the proximal end of the driven shaft, the proximal end of the driver shaft passing through the gear case cover, the gear case cover being removable from the bearing housing without any disconnection of the first and second timing gears from the driver and driven shafts respectively, the first and second timing gears being removable from the driver and driven shafts respectively after removal of the gear case cover, the first and second thrust bearing assemblies being removable from the driver and driven shafts respectively after removal of the first and second timing gears, the bearing housing being removable from the casing after removal of the first and second thrust bearing assemblies, whereby the first and second seal assemblies may be removed after removal of the bearing housing.

5. The pump of claim 1 wherein the casing further comprising a first aperture for receiving a portion of the driver shaft disposed between the first lobe gear and the first thrust bearing assembly, the casing further comprising a second aperture for receiving a portion of the driven shaft disposed between the second lobe gear and the second thrust bearing assembly, the first and second apertures of the casing accommodating sleeve bearings that are in communication with fluid being pumped by the first and second lobe gears.

6. The pump of claim 5 wherein each receiving aperture of the head plate accommodates sleeve bearings that are in communication with fluid being pumped by the first and second lobe gears.

7. A high pressure rotary lobe pump comprising:

a driver shaft that passes through and is connected to a first timing gear, the driver shaft further passing through and being connected to a first lobe gear, the first lobe gear being disposed inside a casing, a driven shaft that passes through and is connected to a second timing gear, the driven shaft further passing through and being connected to a second lobe gear, the second lobe gear being disposed inside the casing, the casing further comprising an open distal end that is connected to a head plate, the driver shaft and driven shaft each comprising a distal end that engages the head plate, wherein the head plate further comprising a pair of opposing recesses disposed on opposing sides of the distal ends of the driver and driven shafts, the recesses for improving loading and unloading of the first and second lobe gears, the casing further comprising a first aperture for receiving a portion of the driver shaft disposed between the first lobe gear and the first timing gear, the casing further comprising a second aperture for receiving a portion of the driven shaft disposed between the second lobe gear and the second timing gear, the first and second apertures of the casing accommodating sleeve bearings disposed immediately adjacent to the lobes and that are in communication with fluid being pumped by the first and second lobe gears, the driver shaft also passing through and is connected to a first thrust bearing assembly, the first thrust bearing assembly being disposed between the first lobe gear and the first timing gear, the first thrust bearing assembly comprising a first bearing cartridge that accommodates at least one bearing between the driver shaft and the first bearing cartridge, the first thrust bearing cartridge further being threadably connected to a bearing housing that is connected to the casing whereby rotation of the first thrust bearing cartridge with respect to the bearing housing results in axial movement of the driver shaft and the first lobe gear within the casing, and the driven shaft also passing through and being connected to a second thrust bearing assembly, the second thrust bearing assembly being disposed between the second lobe gear and the second timing gear, the second thrust bearing assembly comprising a second bearing cartridge that accommodates at least one bearing between the driven shaft and the second bearing cartridge, the second thrust bearing cartridge further being threadably connected to the bearing housing whereby rotation of the second thrust bearing cartridge with respect to the bearing housing results in axial movement of the driven shaft and the second lobe gear within the casing.

8. The pump of claim 7 wherein the head plate further comprises two receiving apertures for receiving the distal ends of the driver and driven shafts, each receiving aperture of the head plate accommodates sleeve bearings that are in communication with fluid being pumped by the first and second lobe gears.

9. The pump of claim 7 wherein the casing further comprising a pair of opposing recesses disposed on opposing sides of the lobe gears from the recesses in the head plate and in general alignment with the recesses in the head plate, the recesses in the casing for improving loading and unloading of the first and second lobe gears.

10. The pump of claim 7 further comprising first and second seal assemblies disposed around the driver and driven shafts respectively and between the casing and the bearing housing, and wherein the driver and driven shafts each comprise proximal ends and wherein the bearing housing is connected to a gear case cover that encloses the first and second timing gears and the proximal end of the driven shaft, the proximal end of the driver shaft passing through the gear case cover, the gear case cover being removable from the bearing housing without any disconnection of the first and second timing gears from the driver and driven shafts respectively, the first and second timing gears being removable from the driver and driven shafts respectively after removal of the gear case cover, the first and second thrust bearing assemblies being removable from the driver and driven shafts respectively after removal of the first and second timing gears, the bearing housing being removable from the casing after removal of the first and second thrust bearing assemblies, whereby the first and second seal assemblies may be removed after removal of the bearing housing.

11. A high pressure rotary lobe pump comprising:

a driver shaft that passes through and is connected to a first timing gear, the driver shaft further passing through and being connected to a first lobe gear, the first lobe gear being disposed inside a casing, the driver shaft also passing through and being connected to a first thrust bearing assembly, the first thrust bearing assembly being disposed between the first lobe gear and the first timing gear, the first thrust bearing assembly comprising a first bearing cartridge that accommodates at least one bearing between the driver shaft and the first bearing cartridge, the first thrust bearing cartridge further being threadably connected to a bearing housing that is connected to the casing, whereby rotation of the first thrust bearing cartridge with respect to the bearing housing results in axial movement of the driver shaft and the first lobe gear within the casing, and a driven shaft that passes through and is connected to a second timing gear, the driven shaft further passing through and being connected to a second lobe gear, the second lobe gear being disposed inside the casing, the driven shaft also passing through and being connected to a second thrust bearing assembly, the second thrust bearing assembly being disposed between the second lobe gear and the second timing gear, the second thrust bearing assembly comprising a second bearing cartridge that accommodates at least one bearing between the driven shaft and the second bearing cartridge, the second thrust bearing cartridge further being threadably connected to the bearing housing whereby rotation of the second thrust bearing cartridge with respect to the bearing housing results in axial movement of the driven shaft and the second lobe gear within the casing, and wherein the casing further comprising an open distal end that is connected to a head plate, the driver shaft and driven shaft each comprising a distal end that engages the head plate, the head plate comprising two receiving apertures for receiving the distal ends of the driver and driven shafts, the head plate further being disposed adjacent to the first and second lobe gears, the head plate comprising a pair of opposing recesses disposed on opposing sides of the distal ends of the driver and driven shafts, the recesses providing clearance between distal ends of the lobe gears and the head plate at the recesses, the recesses for improving loading and unloading of the first and second lobe gears.

12. The pump of claim 11 wherein the casing further comprising a pair of opposing recesses disposed on opposing sides of the driver and driven shafts between the lobe gears and the bearing housing, the recesses in the casing for improving loading and unloading of the first and second lobe gears.

13. The pump of claim 11 further comprising first and second seal assemblies disposed around the driver and driven shafts respectively and between the casing and the bearing housing, and wherein the driver and driven shafts each comprise proximal ends and wherein the bearing housing is connected to a gear case cover that encloses the first and second timing gears and the proximal end of the driven shaft, the proximal end of the driver shaft passing through the gear case cover, the gear case cover being removable from the bearing housing without any disconnection of the first and second timing gears from the driver and driven shafts respectively, the first and second timing gears being removable from the driver and driven shafts respectively after removal of the gear case cover, the first and second thrust bearing assemblies being removable from the driver and driven shafts respectively after removal of the first and second timing gears, the bearing housing being removable from the casing after removal of the first and second thrust bearing assemblies, whereby the first and second seal assemblies may be removed after removal of the bearing housing.

14. The pump of claim 11 wherein the casing further comprising an open distal end that is connected to a head plate, the casing further comprising a first aperture for receiving a portion of the driver shaft disposed between the first lobe gear and the first thrust bearing assembly, the casing further comprising a second aperture for receiving a portion of the driven shaft disposed between the second lobe gear and the second thrust bearing assembly, the first and second apertures of the casing accommodating sleeve bearings that are in communication with fluid being pumped by the first and second lobe gears.

15. The pump of claim 14, wherein the driver shaft and driven shaft each comprising a distal end that engages the head plate, the head plate further comprising two receiving apertures for receiving the distal ends of the driver and driven shafts, each receiving aperture of the head plate accommodating sleeve bearings that are in communication with fluid being pumped by the first and second lobe gears.

16. A high pressure rotary lobe pump comprising:

a driver shaft that passes through and is connected to a first timing gear, the driver shaft further passing through and being connected to a first lobe gear, the first lobe gear being disposed inside a casing, the driver shaft also passing through and being connected to a first thrust bearing assembly, the first thrust bearing assembly being disposed between the first lobe gear and the first timing gear, the first thrust bearing assembly comprising a first bearing cartridge that accommodates at least one bearing between the driver shaft and the first bearing cartridge, the first thrust bearing cartridge further being threadably connected to a bearing housing that is connected to the casing, a driven shaft that passes through and is connected to a second timing gear, the driven shaft further passing through and being connected to a second lobe gear, the second lobe gear being disposed inside the casing, the driven shaft also passing through and being connected to a second thrust bearing assembly, the second thrust bearing assembly being disposed between the second lobe gear and the second timing gear, the second thrust bearing assembly comprising a second bearing cartridge that accommodates at least one bearing between the driven shaft and the second bearing cartridge, the second thrust bearing cartridge further being threadably connected to the bearing housing, the pump further comprising first and second seal assemblies disposed around the driver and driven shafts respectively and between the casing and the bearing housing, and wherein the driver and driven shafts each comprise proximal ends and wherein the bearing housing is connected to a gear case cover that encloses the first and second timing gears and the proximal end of the driven shaft, the proximal end of the driver shaft passing through the gear case cover, the gear case cover being removable from the bearing housing without any disconnection of the first and second timing gears from the driver and driven shafts respectively, the first and second timing gears being removable from the driver and driven shafts respectively after removal of the gear case cover, the first and second thrust bearing assemblies being removable from the driver and driven shafts respectively after removal of the first and second timing gears, the bearing housing being removable from the casing after removal of the first and second thrust bearing assemblies, whereby the first and second seal assemblies may be removed after removal of the bearing housing, wherein the casing further comprising an open distal end that is connected to a head plate, the driver shaft and driven shaft each comprising a distal end that engages the head plate, the head plate comprising two receiving apertures for receiving the distal ends of the driver and driven shafts, the head plate further being disposed adjacent to the first and second lobe gears, the head plate comprising a pair of opposing recesses disposed on opposing sides of the distal ends of the driver and driven shafts, the recesses providing clearance between distal ends of the lobe gears and the head plate at the recesses, the recesses for improving loading and unloading of the first and second lobe gears, and wherein the casing further comprising a pair of opposing recesses disposed on opposing sides of the driver and driven shafts between the lobe gears and the bearing housing, the recesses in the casing for improving loading and unloading of the first and second lobe gears.

17. The pump of claim 16 whereby rotation of the first thrust bearing cartridge with respect to the bearing housing results in axial movement of the driver shaft and the first lobe gear within the casing, and whereby rotation of the second thrust bearing cartridge with respect to the bearing housing results in axial movement of the driven shaft and the second lobe gear within the casing.

18. The pump of claim 16 wherein the casing further comprising an open distal end that is connected to a head plate, the casing further comprising a first aperture for receiving a portion of the driver shaft disposed between the first lobe gear and the first thrust bearing assembly, the casing further comprising a second aperture for receiving a portion of the driven shaft disposed between the second lobe gear and the second thrust bearing assembly, the first and second apertures of the casing accommodating sleeve bearings that are in communication with fluid being pumped by the first and second lobe gears.

19. The pump of claim 18, wherein the driver shaft and driven shaft each comprising a distal end that engages the head plate, the head plate further comprising two receiving apertures for receiving the distal ends of the driver and driven shafts, each receiving aperture of the head plate accommodating sleeve bearings that are in communication with fluid being pumped by the first and second lobe gears.

20. A method of changing the seal assemblies in a dual shaft lobe pump having a construction characterized by a driver shaft that passes through and that is connected to a first timing gear, the driver shaft further passing through and being connected to a first lobe gear, the first lobe gear being disposed inside a casing, the driver shaft also passing through and being connected to a first thrust bearing assembly, the first thrust bearing assembly being disposed between the first lobe gear and the first timing gear, the first thrust bearing assembly including a first bearing cartridge that accommodates at least one bearing between the driver shaft and the first bearing cartridge, the first thrust bearing cartridge further being threadably connected to a bearing housing that is connected to the casing, a driven shaft that passes through and is connected to a second timing gear, the driven shaft further passing through and being connected to a second lobe gear, the second lobe gear being disposed inside the casing, the driven shaft also passing through and being connected to a second thrust bearing assembly, the second thrust bearing assembly being disposed between the second lobe gear and the second timing gear, the second thrust bearing assembly including a second bearing cartridge that accommodates at least one bearing between the driven shaft and the second bearing cartridge, the second thrust bearing cartridge further being threadably connected to the bearing housing, the pump further including first and second seal assemblies disposed around the driver and driven shafts respectively and between the casing and the bearing housing, the driver and driven shafts each further including proximal ends and wherein the bearing housing is connected to a gear case cover that encloses the first and second timing gears and the proximal end of the driven shaft, the proximal end of the driver shaft passing through the gear case cover, the method comprising the following steps:

removing the gear case cover from the bearing housing without any disconnection of the first and second timing gears from the driver and driven shafts respectively, removing the first and second timing gears from the driver and driven shafts respectively after removing of the gear case cover, removing the first and second thrust bearing assemblies after removing of the first and second timing gears, removing the bearing housing from the casing after removing of the first and second thrust bearing assemblies, removing the first and second seal assemblies after removing of the bearing housing.

* * * * *